US005317816A

United States Patent [19]

Kadakia

[11] Patent Number: 5,317,816

[45] Date of Patent: Jun. 7, 1994

[54] AIR DUCT STRUCTURE FOR CLOTHES DRYER

[75] Inventor: Pratish Kadakia, Fort Dodge, Iowa

[73] Assignee: White Consolidated Industries, Inc., Cleveland, Ohio

[21] Appl. No.: 75,812

[22] Filed: Jun. 11, 1993

[51] Int. Cl.[5] ..... F26B 11/02

[52] U.S. Cl. ..... 34/603; 34/604; 29/DIG. 1

[58] Field of Search ..... 34/133 H, 133 J, 242, 34/243 R, 133 G, 235; 29/402.01, 402.02, 428, DIG. 1

[56] References Cited

U.S. PATENT DOCUMENTS

| | | | |
|---|---|---|---|
| 2,802,282 | 8/1957 | Buck | 34/133 J X |
| 3,099,542 | 7/1963 | Scoyk | 34/133 H |
| 3,270,436 | 9/1966 | Fairgrieve | 34/133 J X |
| 4,557,058 | 12/1985 | Ozawa et al. | 34/133 J X |

*Primary Examiner*—Henry A. Bennet

*Attorney, Agent, or Firm*—Pearne, Gordon, McCoy & Granger

[57] ABSTRACT

A method for simultaneously mechanically bonding an air duct to a clothes dryer cabinet and sealing the spaces between the duct and cabinet to prevent the escape of air therefrom, and for a clothes dryer incorporating the bonded and sealed air duct and cabinet. The clothes dryer cabinet includes a series of vertical side panels and a front panel, the front panel defining an access opening through which access to an interior of a rotatable drum can be gained. An inner surface of the front panel includes an annular flange which generally surrounds the access opening and coaxially nests with and supports the rotatable drum. The annular flange defines an air-communication opening through which, in cooperation with the air duct, air flows from the interior of the drum to a blower unit. During assembly the air duct is located by means of engagement of a locating flange provided by the front panel with a series of positioning tabs on the air duct. The engagement of the tabs with the flange position the air duct adjacent the annular flange such that the air-communication opening is generally surrounded by the air duct. The air duct is thereafter permanently mechanically bonded and sealingly attached to the front panel by a foamed-in-place gasket.

16 Claims, 5 Drawing Sheets

AIR DUCT STRUCTURE FOR CLOTHES DRYER

BACKGROUND OF THE INVENTION

1. Field of the Invention

The present invention generally pertains to domestic clothes dryers and, more specifically, to air ducts and methods of mounting air ducts within domestic clothes dryers.

2. Description of Related Art

Over the years, domestic clothes drying machines have evolved to have a generally common or conventional air flow path. Typically, air is drawn from atmosphere into the appliance cabinet and heated in a heating unit. Heated air is introduced at a rear of a rotatable clothes containing drum and travels through the drum to an exit at the front thereof. As the air exits the drum, it passes through a lint filter and is communicated to a blower unit by way of an air duct. The blower unit draws air from the drum through the filter and the air duct and blows the filtered air to atmosphere or vent. The air duct serves as a connector or bridge between the drum and the blower unit.

The air duct in such systems is typically mounted to the dryer cabinet by one of two methods. The first method employs a series of conventional fasteners which extend through matingly aligned apertures in the air duct and a front panel of the dryer cabinet. The second method uses two-sided adhesive pads to attach the air duct to the inner surface of the front panel. In either case, the edges of the air duct adjacent the front panel are caulked in an attempt to seal the gaps or spaces which are present between the air duct and the front panel.

Although great care may be taken in applying the caulk, spaces or gaps inevitably remain between the air duct and the front panel, and these spaces allow lint and air to leak from the air duct into the interior of the cabinet. Also, due to repeated heating and cooling during and after the drying of clothes, the cabinet and air duct repeatedly shrink, expand, and warp, creating further gaps or spaces between the air duct and the front panel of the cabinet. The elevated temperature of the air within the air duct sometimes has deleterious effects on the caulk, causing it to dry and crack and thereby further increasing the number and size of spaces between the front panel and the air duct. Also, attaching the air duct with conventional fasteners allows undesirable noise to be communicated to the clothes dryer cabinet, while using adhesive pads allow the air duct to vibrate or resonate and often does not provide a firm mechanical joint between the air duct and cabinet.

Therefore, there exists a need in the art for a method of attaching an air duct to a domestic clothes dryer which effectively seals the space between the air duct and the clothes dryer cabinet. There also exists a need in the art for a method of attaching the air duct to the clothes dryer cabinet which does not require separate fasteners, and which simultaneously seals the gaps or spaces between the clothes dryer cabinet and the air duct, and for a clothes dryer which incorporates the bonded and sealed cabinet and air duct. Finally, there exists a need in the art for a method of attaching the air duct to the clothes dryer cabinet which dampens or minimizes the transmission and generation of undesirable noise between the air duct and cabinet.

SUMMARY OF THE INVENTION

The present invention provides a method of simultaneously mechanically bonding an air duct to a clothes dryer cabinet and sealing the spaces or gaps between the cabinet and duct, and a clothes dryer incorporating the bonded and sealed cabinet and duct.

The clothes dryer cabinet includes a front panel which defines an access opening through which the interior of a rotatable clothes containing drum is available. An annular ring projects rearwardly from the front panel. The annular ring coaxially nests with the drum and defines the access opening therefor. The annular ring also defines an air-communication opening which, in cooperation with the air duct, communicates air from the drum to a blower unit and, eventually, to an external vent.

In accordance with the present invention, the air duct is attached or bonded to the front panel downwardly adjacent the annular ring such that the air communication opening is generally surrounded thereby. The air duct is attached to the front panel by a foamed-in-place gasket which simultaneously mechanically bonds the duct and the panel and seals the gaps or spaces therebetween.

In further accordance with the present invention, the foamed-in-place gasket provides a permanent bond between the air duct and the cabinet which dampens or minimizes the transmission and generation of noise therebetween, and thereby prevents noise generated or created within the rotatable drum from escaping into the cabinet through the air duct. The air duct is permanently bonded or attached to the front panel by the foamed in place gasket, the leakage of air and lint between the duct and panel is precluded.

BRIEF DESCRIPTION OF THE DRAWINGS

A fuller understanding of the invention may be had by referring to the following description and claims, taken in conjunction with the accompanying drawings, wherein:

DETAILED DESCRIPTION OF THE PREFERRED EMBODIMENT

Figure 1:
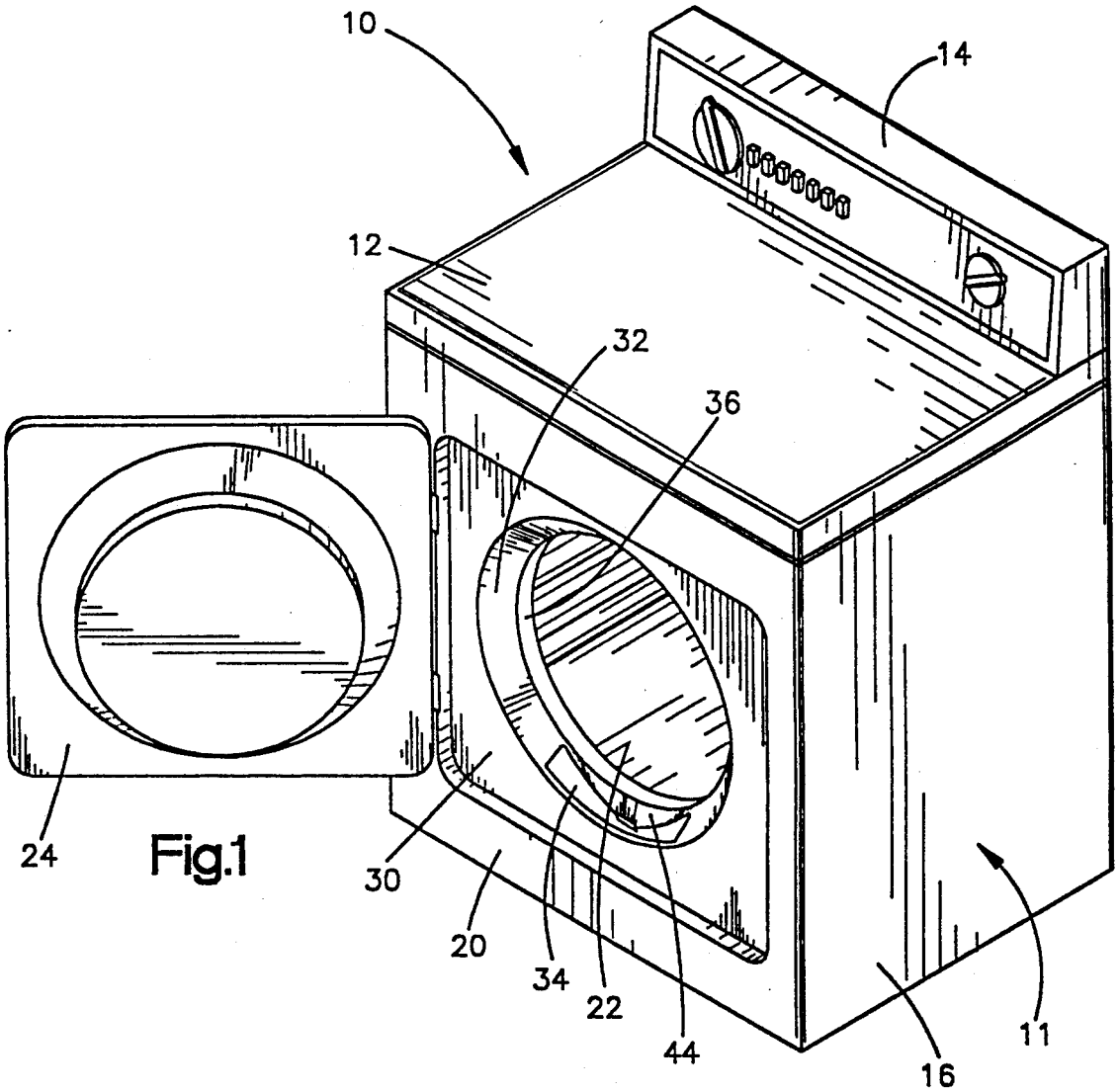
FIG. 1 is a front perspective view of a domestic clothes dryer incorporating the present invention.

With reference to FIG. 1, a clothes dryer 10 of the domestic type incorporating the present invention is illustrated. The clothes dryer 10 has a box-like cabinet 11 of painted sheet metal, as is well known in the art. The dryer cabinet 11 includes a horizontal top panel 12 with a control console 14 extending along its rear edge. The control console 14 provides various control instruments which allow the user to regulate the operation of the clothes dryer 10 so as to provide drying of clothes placed within the dryer in a predetermined manner. The dryer 10 further includes a pair of vertical side panels 16 (one shown) and a vertical rear panel (not shown).

A vertical front panel 20 provides an access opening 22 which is normally closed by a door 24 that is hinged along its left edge, as shown, for movement about a vertical axis. When the door 24 is open as shown in FIG. 1, a user can reach through the access opening 22 and into the interior of the clothes dryer 10 to insert clothing therein or remove clothing therefrom.

Figure 2:
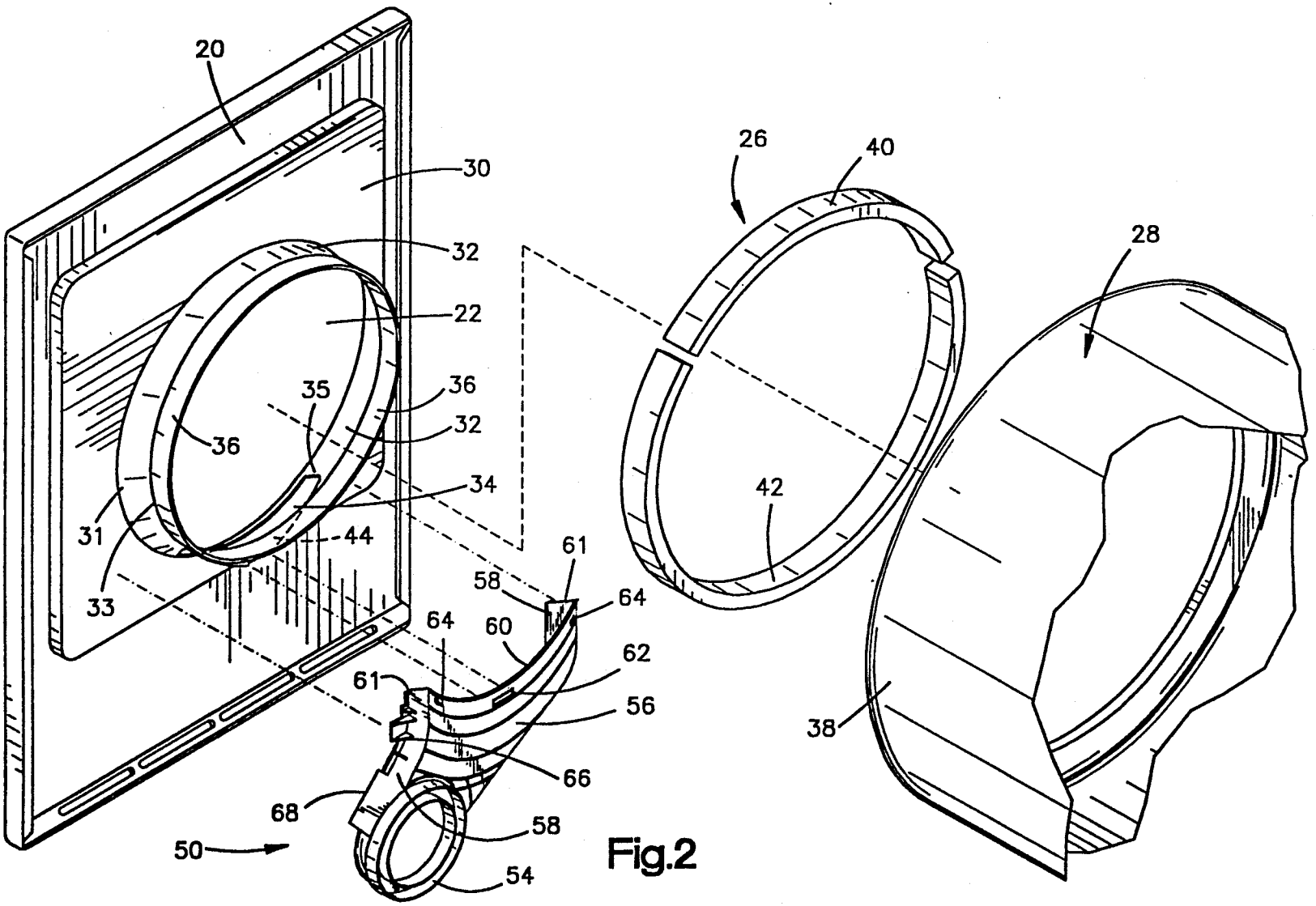
FIG. 2 is a rear exploded perspective view of a front portion of the clothes dryer of FIG. 1.

Turning to FIG. 2 of the drawings, the clothes dryer 10 discussed with regard to FIG. 1 can be seen to include, in addition to the front panel 20, a bearing and seal assembly 26 and a rotatably mounted clothes containing drum 28 that in operation rotates on a horizontal axis.

The front panel 20 has an inwardly-projecting rectangular inner panel 30. As shown best in FIG. 1, the inner panel 30 is sized and adapted to receive the door 24, an outer surface of the inner panel providing a seat against which the door 24 seals during operation of the dryer 10. A conventional switch (not shown) is provided adjacent the front panel to preclude operation of the dryer without closure of the door 24 against the front panel 20.

Centrally located in the inner panel 30 is an aperture constituting, in part, the access opening 22 (FIG. 1). With further reference to FIG. 2, surrounding the access opening 22, the inner panel 30 includes a rearwardly or inwardly projecting annular member or transition ring 32. The transition ring 32 is generally frustoconical, having a relatively larger diameter at an end 31 adjacent the inner panel 30 and a relatively smaller diameter at an end 33 spaced rearwardly from the inner panel 30. Preferably, an axis of the smaller diameter end 33 is relatively vertically above, but in line with, an axis of the larger diameter end 31. A lower portion of the transition ring 32 defines a generally rectangular and curved air communication opening 34. The air communication opening is preferably adapted to slidably receive a lint filter (not shown).

The transition ring 32 extends inwardly from the inner panel 30 and integrally includes and supports a generally circular or ring-shaped drum support flange 36 at a location spaced from the inner panel. The drum support flange 36 is adapted to receive and engage the bearing and seal assembly 26, and to support a front end 38 of the drum 28.

The bearing and seal assembly 26, which preferably is placed over and attached to the circular drum support flange 36, rotatably supports the front end 38 of the dryer drum 28, the rear end (not shown) of the drum being supported by conventional means. The illustrated bearing and seal assembly 26 includes an upper felt member 40 of a high density felt material and a lower felt member 42 of a relatively lower density felt material. The high density of the upper felt member 40 helps to prevent compression thereof due to the load or weight of the front end 38 of the dryer drum 28. The lower felt member 42 is formed from relatively low-cost lower density material because it does not support the load of the dryer drum 28 and, hence, is not subjected to similar compressive forces.

For a more detailed explanation of the construction and operation of the bearing and seal assembly 26, reference should be made to the commonly assigned and co-pending U.S. patent application Ser. No. 08/029,879 the entire disclosure of which is expressly incorporated herein.

Inwardly adjacent the air communication opening 34, the transition ring provides a downwardly-directed positioning flange 44. The positioning flange 44, which preferably comprises metal which was cut and bent away to form the air communication opening 34, helps locate an air duct 50 relative to the air communication opening 34 and the front panel 20 during assembly. The flange defines a central notched portion 46 and a pair of laterally opposite ends 48 which cooperated to locate the air duct 50 relative to the front panel 20, as will be described more fully hereafter.

The remaining edges of the air communication opening 34 (i.e., ones other than the inward edge comprising the positioning flange 44) have a downturned or downwardly-directed lip (not shown) which facilitates engagement and retention of the air duct 50. As will be clear from the following discussion, the portions of the downturned lip adjacent lateral or side edges 35 of the air communication opening 34 engage and assist in locating and retaining the air duct.

The air duct 50 includes a bowl-shaped section 54, an outer panel 56, and a pair of sidewall panels 58. As illustrated, an upper terminal edge 60 of the outer panel 56 is arcuate or curved to generally conform with the peripheral contour or shape of the transition ring 32 at a location outwardly adjacent the air communication opening 34. Similarly, upper terminal edges 61 of the sidewall panels 58 generally conform to the contour or shape of the transition ring 32 as it linearly progresses from a relatively larger diameter adjacent the inner panel 30 to a relatively smaller diameter outwardly adjacent the air communicating opening 34. The upper terminal edges 61 of the sidewall panels 58 slidably engage an outer surface of the downturned lip adjacent the lateral or side edges 35 of the air communication opening 34. The outer panel 56 converges or narrows toward the bowl-shaped section 54 to provide a smooth air-flow transition between the air communication opening 34 and an air transporting duct (not shown) attached to the bowl-shaped section.

The outer panel 56 includes a central positioning tab 62 and a pair of laterally-spaced positioning tabs 64. As shown best in FIG. 6, the positioning tabs 62, 64 are roughly L-shaped in cross section, extending away from the outer panel 56 (toward front panel 20) and upwardly. The positioning tabs 62, 64 and are adapted to releasably and slidably receive the positioning flange 44. More specifically, the central tab 62 releasably engages the positioning flange 44 adjacent the notched portion 46 while the lateral tabs 64 engage the opposite ends 48 of the flange. When assembled, the flange 44 is trapped between the positioning tabs 62, 64 and the outer panel 56.

Figure 5:
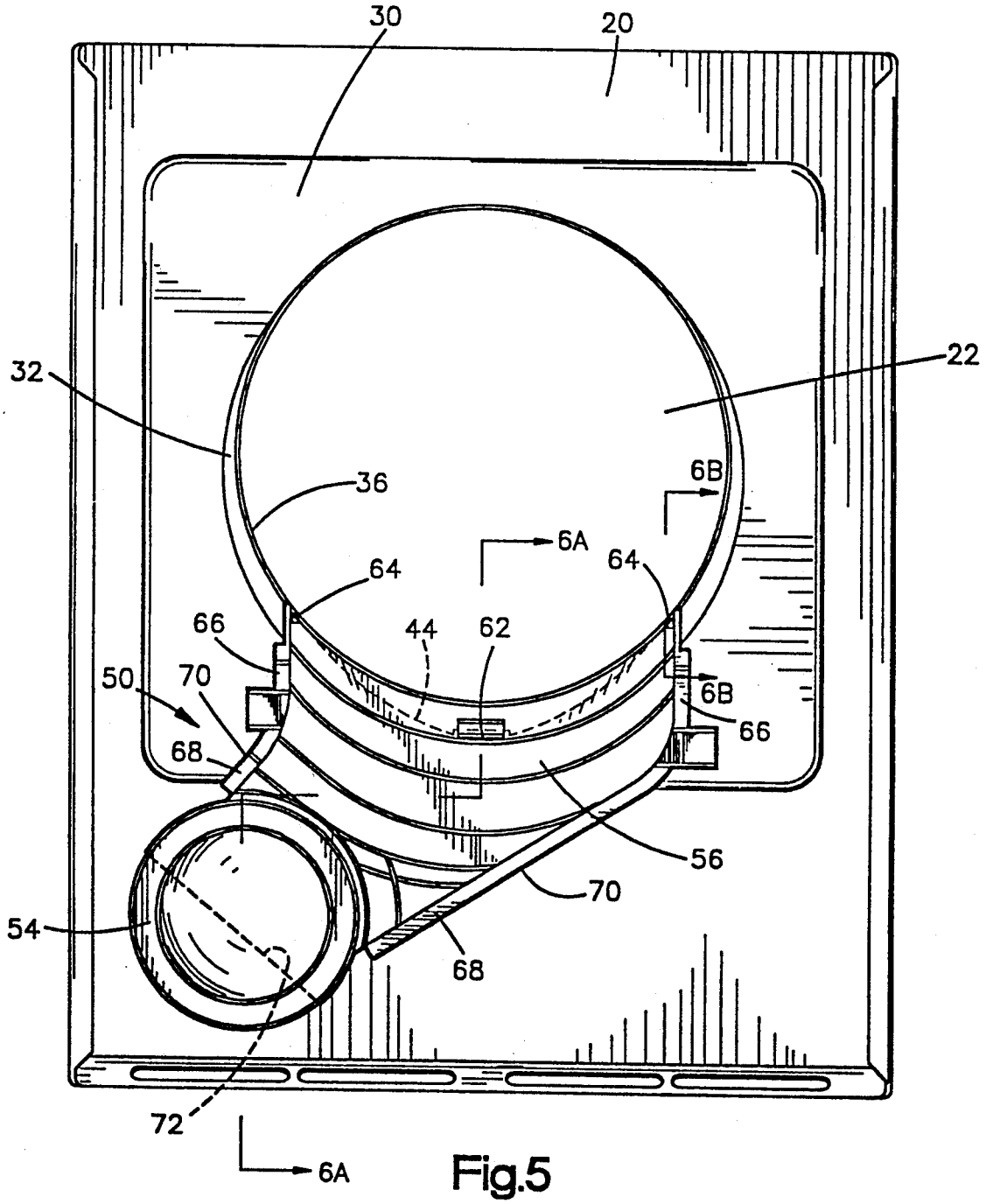
FIG. 5 is a rear elevational view of the front portion of the clothes dryer of FIG. 2, with the air duct mounted to the front panel.

The sidewall panels 58 include a front panel engaging edge which can be divided or separated into upper and lower edge portions 66, 68. The upper edge portions 66 are notched or recessed relative to the lower edge portions 68 to accommodate the rearwardly projecting inner panel 30 (FIG. 5). The lower portions 68 extend outwardly beyond the upper portions 66 to engage the front panel 20 downwardly adjacent the inner panel 30, thereby insuring continuous contact between the air duct 50 and the front panel 30, as illustrated. Thus, the edge surface of the air duct 50 adjacent the front panel 20 is adapted and designed to match the contour and shape of the inner surface of the front panel 20 and, as will be described more fully hereafter, will be permanently and sealingly attached to the front panel 20 by a foamed-in-place gasket 70 (FIG. 5).

Figure 6A:
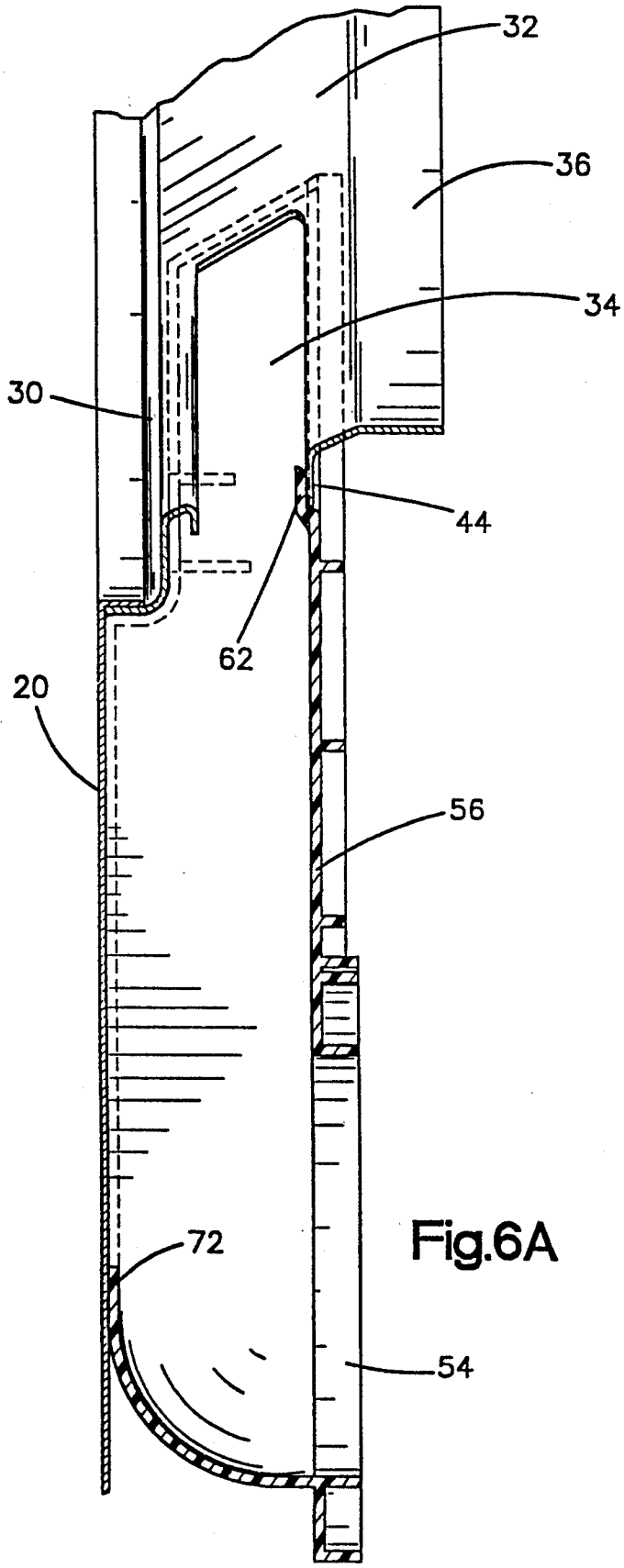
FIG. 6A is a cross-sectional view of the air duct and front panel taken along line 6A—6A of FIG. 5; and, FIG. 6B is a cross-sectional view of the air duct and front panel taken along line 6B—6B of FIG. 5.
Figure 6B:
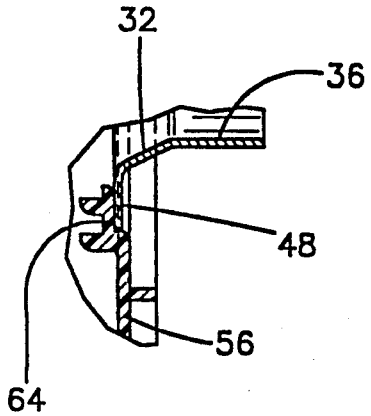

The bowl-shaped section 54 of the air duct 50 serves as a coupling between the air duct and the air-transporting duct which fluidly connects the air duct and blower unit. The bowl-shaped section 54 defines a generally inwardly-opening, semi-spherical surface adjacent the front panel 20 and immediately beneath the inner panel 30 (FIGS. 5, 6A). The bowl-shaped section provides a front panel engaging surface 72 which is generally co-planar with the lower edge portions 68 of the sidewall panels 58. The co-planar lower edge portions 68 and front panel engaging surface 72, together with the co-planar upper edge portions 66, define a generally continuous engagement surface to facilitate sealingly and permanently bonding the air duct 50 to the inner surface of the front panel 20.

Preliminary mounting of the air duct 50 to the front panel 20 of the cabinet 11 will be described hereafter with reference to the foregoing description and drawings.

Figure 3:
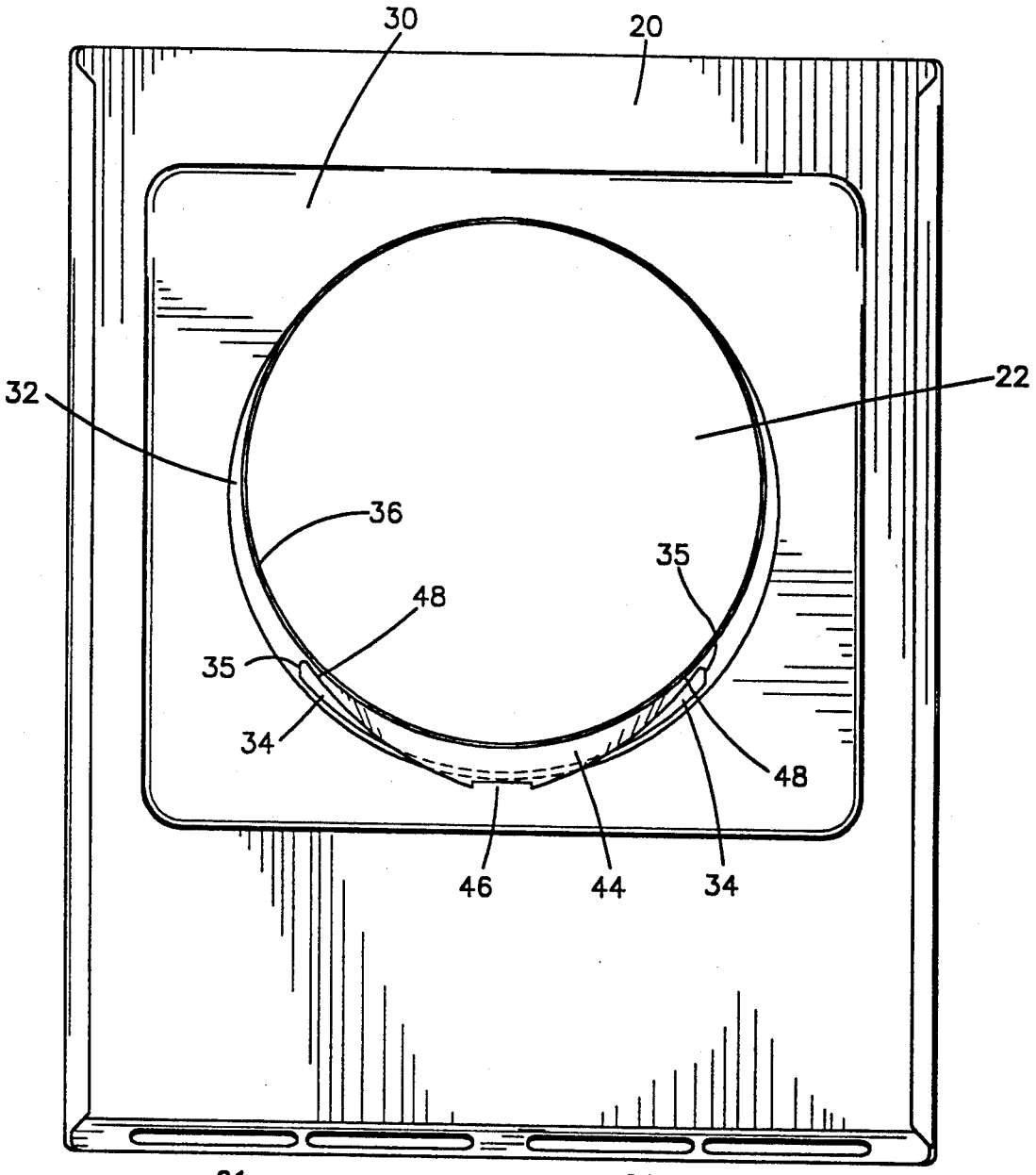
FIG. 3 is a rear elevational view of a front panel of the clothes dryer.
Figure 4:
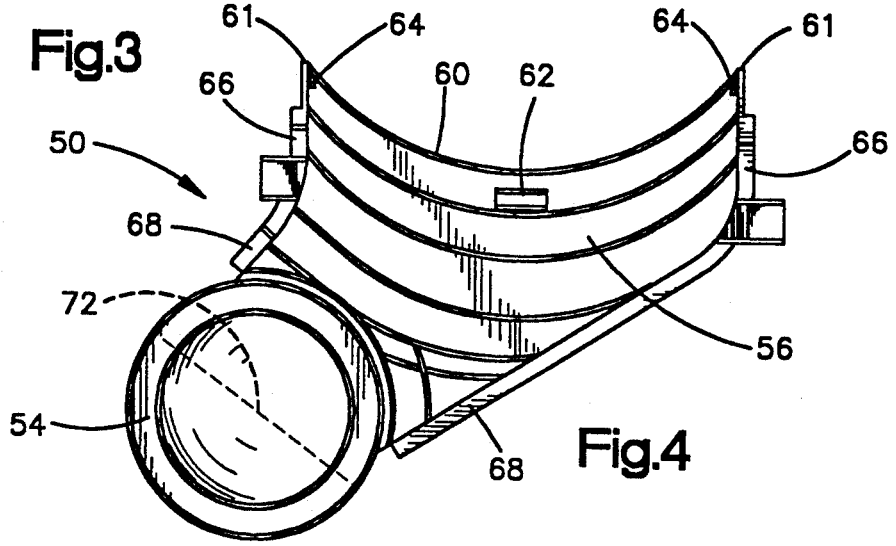
FIG. 4 is a rear elevational view of an air duct in accordance with the present invention.

With the front panel 20 positioned generally as shown in FIG. 3, the air duct 50 is brought into engagement with the positioning flange 44. More specifically, the central positioning tab 62 is slid behind the positioning flange 44 such that the notched portion 46 of the flange is received between the central positioning tab 62 and the outer panel 56 of the air duct. In a like manner, the laterally-spaced positioning tabs 64 are simultaneously slid behind the opposite ends 48 of the flange 44. As such, the positioning flange 44 is trapped between the tabs 62, 64 and the outer panel 56, and is properly positioned for final bonding or attachment thereof to the inner surface of the front panel 20.

As so preliminarily mounted, the lower edge portions 68 of the sidewall panels 58 and the surface 72 of the bowl-shaped section 54 are in engagement with the inner surface of the front panel 20 downwardly adjacent the inner panel 30. The upper edge portions 66 of the sidewall panels 58 are in engagement with the inner surface of the inner panel 30. The arcuate upper terminal edge 60 of the outer panel 56 is in contact or engagement with the transition ring 32 inwardly adjacent the air communication opening 34 therein (i.e., adjacent the positioning flange 44). Similarly, the upper terminal edges 61 of the sidewall panels 58 are in contact with the transition ring 32 from a location adjacent the inner panel 30 to a location inwardly adjacent the air communication opening 34 (i.e., adjacent the flange 44). Portions of the downturned lip adjacent the lateral or side edges 35 of the air communication opening 34 are engaged by the sidewall panels 58 adjacent their upper terminal edges 61.

The preliminarily mounted air duct 50 cooperates with the transition ring 32 and the front panel 20 to define an air flow path between the air communication opening 34 and the coupling provided by the bowl-shaped section 54. The air duct 50 is held in place by the engagement and receipt of the flange 44 between the outer panel 56 and the positioning tabs 66, 68, and the engagement of the sidewall panels 58 with the downturned lip at the lateral edges 35 of the air communication opening 34. The upper terminal edges 60, 61 of the outer panel 56 and sidewall panels 58 abut and conform with the transition ring 32 adjacent the air communication opening 34.

However, due to manufacturing tolerances and imperfections, and the effects of temperature, the air duct 50 is not in exact or continuous engagement with the front panel and, thus, air flowing through the duct will leak out of the spaces or gaps between the duct 50 and front panel 20. Such leakage or flow of air is precluded by the final step of assembly to be described hereafter.

With the air duct 50 preliminarily mounted or attached to the front panel via interaction or cooperation of the positioning flange 44 and the positioning tabs 62, 64, as described previously, and with the air duct held or otherwise retained against the inner surface of the front panel 20, a foamed-in-place gasket 70 is applied around the periphery of the air duct. The foamed-in-place gasket 70, as the name states, is an in-situ foaming process wherein an adhesive-carrying foam is directly applied at the locations where the air duct 50 meets the front panel.

The foamed-in-place gasket 70 is preferably applied only along the front panel engaging edges of the upper and lower edge portions 66, 68, and along the front panel engaging surface 72 of the bowl-shaped section 54. Thus, the air duct in the preferred embodiment is sealed or bonded to the cabinet along three sides or edges, the top edge comprising the terminal edges 60, 61 is not bonded to the transition ring 32.

Application of the foamed-in-place gasket 70 at the intersection of the air duct 50 and the transition ring 32, although within the scope of the present invention, is not felt necessary due to the relatively tight fit between the positioning flange 44, the downturned lip, and the air duct 50. Also, air flowing through the duct is directed away from this unsealed area and, therefore, does not tend to leak or flow therethrough. Rather, it is believed that this unbonded or unsealed portion may allow the duct 50 and the front panel 20 or transition ring 32 a certain degree of freedom of movement to account for temperature-resultant warping or size changes therein.

The inventor has found that commercially available glues or adhesives sold under the tradenames BOSTIK 9060 or BOSTIK 9061 by Bostik Corporation of Middleton, Mass., are satisfactory for the foamed-in-place gasket of the present invention. The solid glue, in brick form, is combined with liquid nitrogen to produce a foam which, when applied to the cabinet and air duct, cures or hardens in about 30 to 60 seconds, mechanically bonding and sealing the duct 50 and front panel 20. After the foamed-in-place gasket 70 has cured, the air duct 50 is permanently bonded to the front panel 20.

By attaching the air duct 50 to the front panel 20 in the aforementioned manner, several operational and manufacturing or assembly advantages are gained over the prior art methods of attachment. Firstly, for example, no supplementary or additional independent fasteners or attachment devices are necessary to attach the air duct to the front panel, reducing the parts, inventory, and assembly costs associated with this manufacturing procedure. Secondly, since the foamed-in-place gasket 70 is not particularly conductive of sound or vibration, sound or noise generated or transmitted by the rotatable drum is less likely to be conveyed or transferred to the cabinet via the air duct than when conventional fasteners are employed. Thirdly, the present invention eliminates the use of caulk, which requires approximately four minutes to cure as opposed to the less than one minute for the foamed-in-place gasket 70 utilized in the present invention. Therefore, the present invention further speeds the assembly process.

While the preferred embodiment of the present invention is shown and described herein, it is to be understood that the same is not so limited but shall cover and include any and all modifications thereof which fall within the purview of the invention. For example, it is contemplated that the foamed-in-place gasket 70 could be directly applied to the front panel 20 prior to placement of the air duct 50 thereon. Similarly, prior to attachment of the air duct to the front panel, the foamed-in-place gasket 70 could be applied to the air duct surfaces which will engage the front panel. Therefore, it should be clear that the scope of the invention is not limited to the preferred embodiment specifically described herein. Rather, the present invention is only limited or defined by the claims appended hereto.

What is claimed is:

1. A clothes dryer cabinet assembly comprising a front panel, an air duct, and a foamed-in-place gasket, said front panel including an inwardly projecting annular member which generally surrounds an access opening defined by said front panel, said annular member defining an air communication opening through which air flows into an air communication channel defined by the front panel and the air duct, wherein the foamed-in-place gasket is provided at locations where an edge of the air duct abuts the front panel, said foamed-in-place gasket permanently mechanically bonding the air duct to the front panel adjacent said air communication opening.

2. A clothes dryer cabinet assembly as recited in claim 1, wherein said air duct further comprises an outer panel and a pair of sidewall panels, edges of said sidewall panels adjacent said front panel being permanently bonded thereto by said foamed-in-place gasket.

3. A clothes dryer cabinet assembly as recited in claim 2, wherein said annular member provides a positioning flange, said positioning flange being adjacent said air communication opening and engaged by the air duct to locate said air duct relative to said air communication opening and said front panel.

4. A clothes dryer cabinet assembly as recited in claim 3, wherein said outer panel provides one or more positioning tabs, said positioning flange being received by the said one or more positioning tabs thereby positioning said air duct relative to said front panel and said air communication opening.

5. A clothes dryer cabinet assembly as recited in claim 4, wherein the outer panel and the sidewall panels have upper edges which abut the annular member.

6. A domestic clothes dryer, said clothes dryer comprising a cabinet, said cabinet having vertical side panels and a vertical front panel, said front panel defining an access opening through which an interior of the clothes dryer can be accessed, an inner surface of said front panel comprising an annular support flange, said annular support flange generally surrounding said access opening and providing means for supporting a front end of a rotatable drum, said drum having a generally horizontal axis and an open front, said open front being generally coaxially nested with said annular flange such that an interior of said drum is accessible via the access opening, said annular flange also providing an air-communication opening through which air from said drum can be communicated to an air communication channel defined by said front panel and an air duct, said air duct being attached to the front panel downwardly adjacent the annular support flange by a foamed-in-place gasket, said air duct generally surrounding said air-communication opening and cooperating with the front panel to define the air communication channel through which air from the interior of said drum passes toward a vent, wherein the foamed-in-place gasket simultaneously seals spaces between said air duct and said front panel and permanently mechanically bonds said air duct to said front panel.

7. A clothes dryer as recited in claim 6, wherein said air duct further comprises an outer panel and a pair of sidewall panels, edges of said sidewall panels adjacent said front panel being permanently bonded thereto by said foamed-in-place gasket.

8. A clothes dryer as recited in claim 7, wherein said annular member provides a positioning flange, said positioning flange being adjacent said air communication opening and engaged by said air duct to locate said air duct relative to said air communication opening and said front panel.

9. A clothes dryer as recited in claim 8, wherein said outer panel provides one or more positioning tabs, said positioning flange being received between said one or more positioning tabs and said outer panel, thereby positioning said air duct relative to said front panel and said air communication opening.

10. A clothes dryer as recited in claim 9, wherein the outer panel and the sidewall panels have upper edges which abut the annular member.

11. A method of attaching an air duct to a clothes dryer cabinet, said clothes dryer cabinet having a plurality of vertical side panels and a vertical front panel, an inner surface of said front panel including an annular support flange which coaxially nests with an open front end of a rotatable drum, said front panel defining an access opening through which an interior of the rotatable drum is accessible, said support flange defining an air-communication opening through which air from the interior of the drum is communicated toward a vent via the air duct, said method comprising the steps of:

positioning the air duct relative to the air communication opening and the front panel, said air duct having an edge surface which is in generally continuous contact with the inner surface of the front panel; and, applying a foamed-in-place gasket along the edge surface of the air duct, said foamed-in-place gasket sealing spaces between the air duct edge surface and the front panel and permanently mechanically bonding the duct to the front panel.

12. A method of attaching an air duct to a clothes dryer cabinet as recited in claim 11, wherein the annular support flange provides a downwardly directed positioning flange adjacent the air communication opening, said air duct including one or more positioning tabs which are adapted to slidably receive said positioning flange.

13. A method of attaching an air duct to a clothes dryer cabinet as recited in claim 11, wherein the positioning step further comprises the steps of:

placing the air duct adjacent the front panel; and, upwardly moving the air duct so that the positioning flange provided by the annular support flange is received by the one or more positioning tabs and the edge surfaces of the air duct are in contact with the inner surface of the front panel, thereby locating the air duct relative to the front panel and the air communication opening.

14. A method of attaching an air duct to a clothes dryer cabinet as recited in claim 11, further comprising the step of waiting a period of time for the foamed-in-place gasket to cure.

15. A method of attaching an air duct to a clothes dryer cabinet as recited in claim 14, wherein the cure time is less than one minute.

16. A method of attaching an air duct to a clothes dryer cabinet as recited in claim 15, wherein the positioning step further comprises the steps of:

placing the air duct adjacent the front panel; and, upwardly moving the air duct so that the positioning flange provided by the annular support flange is received by the one or more positioning tabs and the edge surfaces of the air duct are in contact with the inner surface of the front panel, thereby locating the air duct relative to the front panel and the air communication opening.

* * * * *